United States Patent [19]

Berggren

[11] 4,269,365

[45] May 26, 1981

[54] BEATER MILL

[76] Inventor: Torsten L. Berggren, Rosenlidsgatan 13, S-571 00 Nässjö, Sweden

[21] Appl. No.: 58,279

[22] Filed: Jul. 17, 1979

[30] Foreign Application Priority Data

Aug. 7, 1978 [SE] Sweden ..... 7808424

[51] Int. Cl.[3] ..... B02C 7/06

[52] U.S. Cl. ..... 241/152 A; 241/247; 241/261.2

[58] Field of Search ..... 241/28, 245, 246, 247, 241/251, 259.1, 259.2, 261.2, 261.3, 146, 297, 152 A, 261

[56] References Cited

U.S. PATENT DOCUMENTS

| | | | |
|---|---|---|---|
| 1,496,641 | 6/1924 | Hurrell | 241/146 |
| 2,991,020 | 7/1961 | Jones | 241/146 |
| 3,327,952 | 6/1967 | Rosenfeld | 241/28 X |
| 3,371,873 | 3/1968 | Thomas | 241/146 X |

FOREIGN PATENT DOCUMENTS

| | | | |
|---|---|---|---|
| 266391 | 12/1911 | Fed. Rep. of Germany | 241/261.2 |
| 1019530 | 11/1957 | Fed. Rep. of Germany | 241/244 |
| 40259 | 7/1968 | Finland | 241/261.2 |
| 24486 | 4/1914 | Norway | 241/261.2 |
| 323578 | 7/1963 | Sweden | 241/261.2 |

*Primary Examiner*—Mark Rosenbaum

*Attorney, Agent, or Firm*—Frishauf, Holtz, Goodman & Woodward

[57] ABSTRACT

A beater for refining fibre slurries, such as paper pulp, and for refining lump goods, such as wood chips and shavings comprises a central rotor and two outer fixed parts surrounding the rotor. The rotor is provided with two ring-shaped beater means and each of the two outer parts is provided with a ring-shaped beater means to form two beater zones between the beater means, one zone on each side of the rotor, in which zones the goods to be refined are treated during passage thereof substantially radially outwardly and as a result of the relative rotation between the rotor and the outer parts. The rotor has a cavity with an axial inlet for the goods to be refined and radially converging, substantially V-shaped defining walls, in which walls holes are arranged through which the goods can be passed to respective zones via passages formed between the rotor and the surrounding parts. A rotatable propeller-like means is arranged in the cavity to disintegrate the goods and to spread it by centrifugal force and to cause it to divide into two substantially equal flows which pass out through the holes in respective walls and into passages connecting therewith.

15 Claims, 4 Drawing Figures

BEATER MILL

BACKGROUND OF THE INVENTION

The present invention relates to a beater for treating fibre slurries, such as paper pulp, and lump-goods such as wood chips and shavings, in both pumpable and non-pumpable concentrations, said beater comprising beater means which are rotatable relative to one another and between which the goods pass during movement of said beater means in a direction substantially radially outwardly from the center of rotation of said beater means.

Known beaters of this kind are constructed in accordance with three different basic principles:

(a) A rotary and a stationary beater disc (single disc), see FIG. 1, (b) Two beater discs which rotate in mutually opposite directions (double-disc), see FIG. 2, (c) A central rotor having on both sides thereof stationary refiner discs (twin-flow), see FIG. 3.

In the aforementioned figures, the reference numeral 1 indicates the incoming flow of material, the reference numeral 2 identifies rotatable discs provided with beater means, the reference numeral 3 identifies fixed beater discs, the reference numeral 4 identifies a drive shaft, the reference numeral 5 identifies means for applying beater pressure, the reference numeral 6 identifies bearings for taking up axial forces, and the reference numeral 7 identifies bearings for taking up radial forces.

Compared with the constructions of FIGS. 1 and 2, the construction according to FIG. 3. has considerable advantages. By using a beater disc on each side of the rotor, two beater zones are obtained. Among other things, this means that with one and the same rotor diameter there is obtained a disc refiner whose capacity is, in principle, twice that of the others. Moreover, in the constructions according to FIGS. 1 and 2 the beater pressure must be equalized by means of axial bearings while with the construction according to FIG. 3 a beater pressure of equal magnitude will act on both sides of the rotor, and hence no bearings are required to take up axial forces. This is a considerable advantage, since, depending upon the diameter of the disc, the beater force may reach 10–50 tons. Highly sophisticated lubricating and cooling systems are required for the axial bearing in order to take-up such high loads at high revolutions. Despite this, the bearings often become damaged. The construction according to FIG. 3 above is also highly advantageous from the energy-saving aspect, since beating is effected on both sides of the rotor. In the case of a conventional refiner, energy is consumed by the generation of turbulence on the rear side of the rotor.

Known constructions based on the principle of FIG. 3 above are encumbered, however, with serious limitations concerning their use. These constructions namely function in the case of pump-fed systems only with pulp concentrations within the range of up to 4% in the case of long-fibre pulp and up to 6% in the case of short-fibre pulp. At higher concentrations, difficulties are encounted with the distribution of the pulp to the two beater zones, and in obtaining a disturbance-free deflection of incoming, axially flowing pulp to a radial flow through respective beater zones. This is a serious disadvantage, since it limits the machine to a narrow range of use. Present day development is towards refining with increased high pulp concentrations, with the object of saving energy and of obtaining a fibre of better quality, and towards the refining of chips and shavings of high dry-content in order to optimize the yield of wood material.

A known refiner has a central rotor which permits chips, and also shavings, to be refined within a concentration range of 25–40%. This arrangement, however, uses two separate infeed systems for the goods to be refined, one leading to each beater zone, which means that the machine is complicated and expensive to produce. Moreover, high requirements are placed on the accuracy in which the goods are distributed between the two infeed systems.

The main object of the present invention is to provide a beater which affords the advantages of a construction according to FIG. 3 above but in which, inter alia, the aforementioned disadvantages of known machines of this kind are eliminated. In particular, the machine shall be of simple construction and permit the treatment of pulp at both medium and high concentrations and also the treatment of lump-goods, such as chips and shavings.

SUMMARY OF THE INVENTION

This object is achieved with a machine comprising a central body and two outer parts surrounding said body, said central body being provided with two ring-shaped beater means and each of said outer parts being provided with a respective ring-shaped beater means to form two beater zones between said beater means, one zone on each side of the central body, in which zones said goods are treated during the passage thereof substantially radially outwardly and as a result of relative rotation between the central body and said outer parts. The invention is characterized by the fact that the central body is provided with a cavity having an axial inlet for said goods and radially converging, substantially V-shaped defining walls; that holes are arranged in said converging walls, through which holes said goods can be passed to respective zones via passages formed between the central body and the surrounding parts; and in that a rotatable propeller-like means is arranged in said cavity to disintegrate said goods and to spread said goods by centrifugal force and thereafter to divide said goods into two substantially equal flows which pass out through said holes in respective walls and into passages connecting therewith.

Preferably the central body serves as a rotor and the surrounding, outer parts are stationary, the rotor conveniently being provided with external wings arranged between said holes for feeding the material thrown out through said holes in said channels to respective a beater zone. The wings are suitably arranged to co-act with helical blades or grooves arranged on or in said parts surrounding said rotor. To facilitate the flow, the holes in the converging walls of the central body conveniently extend radially, the number of holes being the same for both walls, thereby to obtain uniform distribution of the pulp.

DETAILED DESCRIPTION

Figure 1:
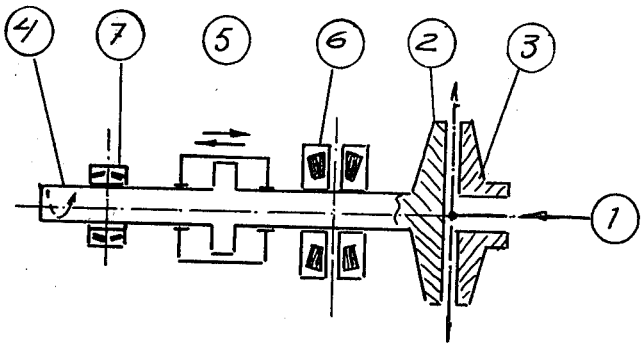
Fig 1 PRIOR ART
FIGS. 1–3 illustrate schematically the design of the basic embodiments of the prior art disc refiners discussed above. No further description of these figures will be made.
Figure 2:
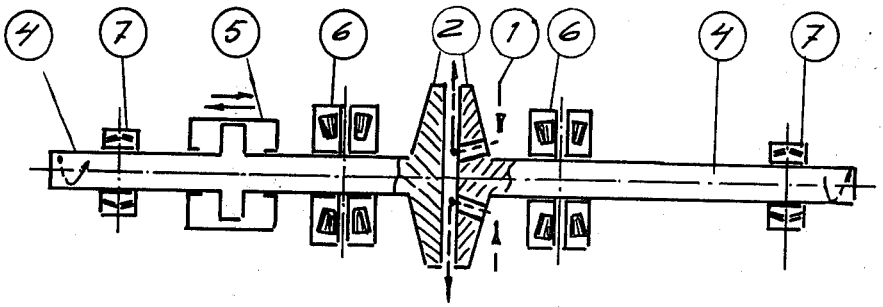
Fig 2 PRIOR ART
Figure 3:
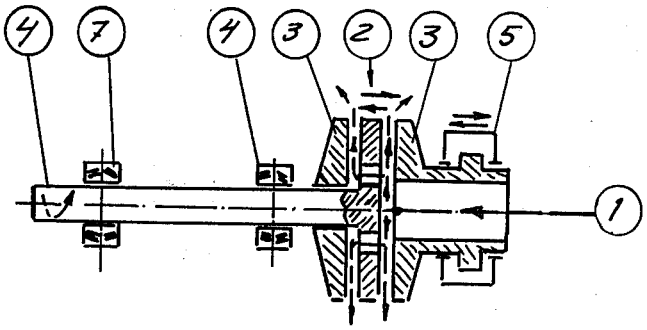
Fig 3 PRIOR ART
Figure 4:
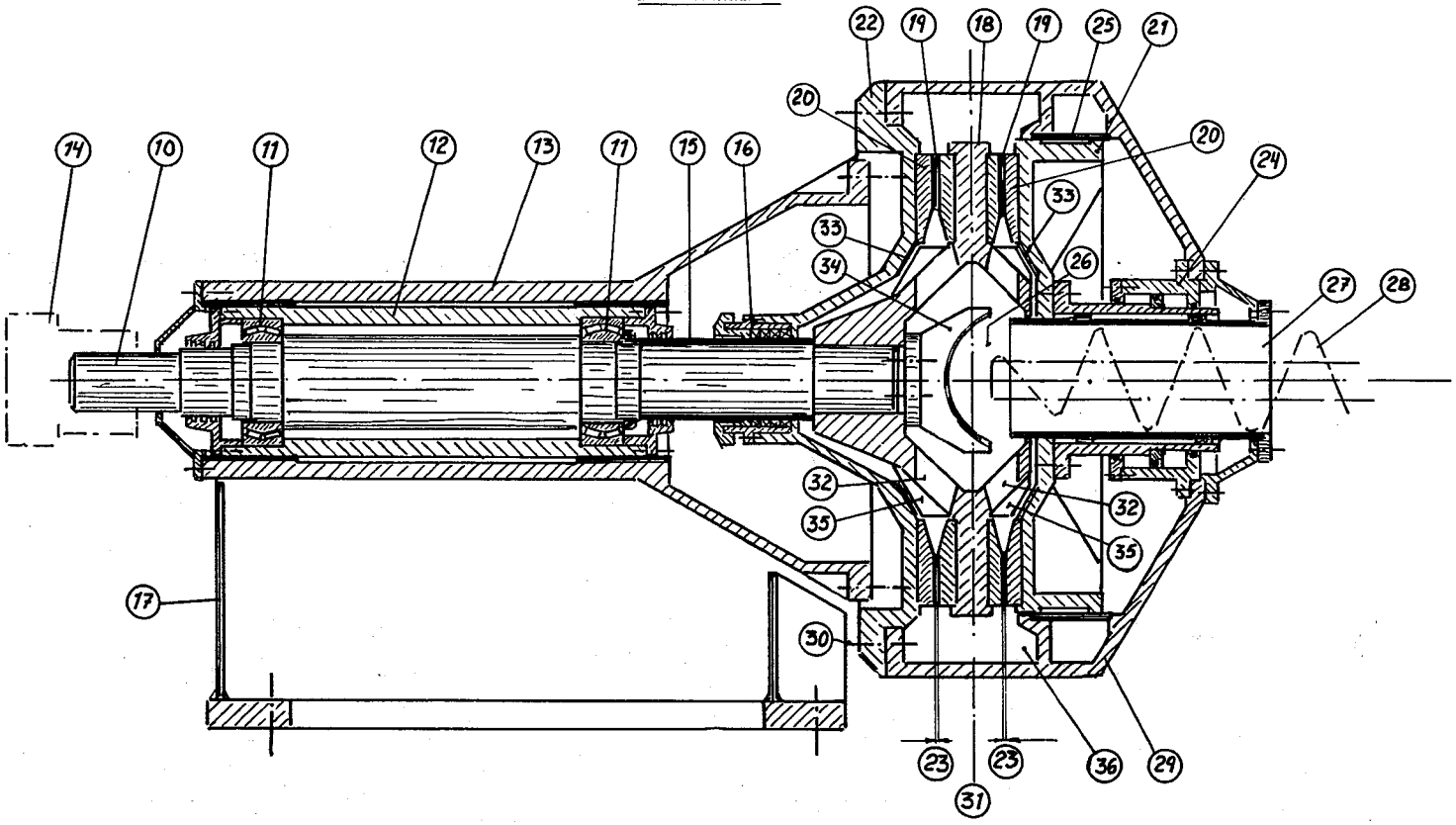
FIG. 4 is a longitudinal sectional view of a beater according to the present invention.

In FIG. 4, the drive shaft 10 of the machine is journalled in two conventional radial bearings 11, which in turn are mounted in a sleeve 12 which is axially displaceable in a frame unit 13. An axially displaceable tooth or spline coupling 14 connects the shaft 10 to a drive motor (not shown). A replaceable wear-sleeve 15 is arranged beneath a conventional stuffing box 16, and a bottom frame 17 is mounted on a support.

Arranged on the drive shaft 10 is a rotor 18 which is provided with a ring-shaped beater means 19 on each of two mutually opposing surfaces thereof. The beater means 19 are arranged to co-act with oppositely located fixed ring-shaped beater means 20 mounted on a front and a rear stator 21 and 22, respectively. Between each pair of beater means 19 and 20 there is formed a beater space 23, through which said goods or said suspension passes in a substantially radial direction.

For the purpose of applying the desired beater force, the front stator 21 is connected with a hydraulic piston system 24, by means of which the stator 21 and associated beater ring 20 can be displaced axially to regulate the size of the gaps 23. To this end, the stator 21 is journalled at its periphery in a sleeve like plain bearing 25. The goods to be refined are passed to the cavity 26 arranged in the center of the rotor 18 by means of a conventional screw conveyor comprising an infeed tube 27 and a screw 28 arranged for rotation therein, said screw extending to a location substantially adjacent a symmetry plane 31 of the rotor 18.

In order to prevent metallic contact between the ring-shaped beater means 19 and 20, a flow monitor (not shown) is arranged in the infeeder, which monitor suitably activates the hydraulic system 24 in a manner such that when the refiner stops or the flow of goods ceases for some reason or other, the stator 21 is withdrawn a certain distance in a direction towards the goods inlet at the same time that the shaft 10 with the rotor 18 is hydraulically moved through half this distance in the same direction. In the closed position, the beater housing 29 is screwed firmly to the back stator 22 by means of bolts 30.

The cavity 26 arranged in the rotor 18 is partially defined by radially diverging, V-shaped walls, in which holes 32 are arranged. The walls suitably form an angle of 30°–60° to the long-axis of the drive shaft 10. Each wall is provided with the same number of holes 32 which are identically arranged and which connect the cavity 26 with passages formed between the external surface of the rotor 18 and the fixed parts 21 and 22 surrounding said rotor, said goods being passed to said spaces or gaps 23 through said passages. The holes 32 in the V-shaped walls of the rotor are radially directed. It is essential that the cavity 26 and the holes 32 are symmetrically formed on both sides of the symmetry plane 31, in order to obtain uniform distribution of the goods to the two beater gaps 23.

For the purpose of disintegrating and distributing the goods fed-in by the screw 28, the cavity 26 has arranged therein a propeller-like device 34 which is attached to and rotates together with the shaft 10. The propeller 34 provides for centrifugal spreading of the goods, said goods being thrown out through the holes 32 into the passages associated with respective gaps or spaces 23. For the purpose of providing an effective feed of the material fed out from the holes 32, the rotor 18 is provided on the outside thereof with wings 35 which are arranged between said holes and which co-act with helical blades 33 or grooves in the inner surfaces of the stator parts 21 and 22.

In the operation of a refiner according to FIG. 4, the goods are fed into the cavity 26 in the rotor 18 by means of the screw 28 arranged in the infeed tube 27. When the goods meet the rotating propeller 34, the goods, which are fed in the form of a tubular plug, are disintegrated by the propeller and are spread out by centrifugal force radially towards the dish-shaped, inner defining surfaces of the rotor cavity 26. As beforementioned, the dish-shape is symmetrical with respect to the symmetry plane 31. When said goods reach the dish-shaped defining surface, the rotary speed of said goods is increased and the goods are thrown out through the symmetrical holes 32 in the obliquely extending legs or walls of the dish.

Tests have shown that complete centrifugal spreading of the goods is obtained at a propeller speed of 700 r.p.m., and equal flow of goods being obtained through the holes 32 in both legs of the dish. At rotational speeds within the range of 700–1400 r.p.m. it is possible to guide the flow to one side or the other by means of the propeller 34, while at speeds above 1400 r.p.m. the design of the propeller seems to have less importance. This applies to both paper pulp at concetrations in excess of 10% and for lump-goods, such as chips and shavings.

The feed blades 35 feed the goods radially outwardly in respective gaps between the rotor 18 and the stator parts 21 and 22 surrounding the same. As beforementioned, these latter parts are provided with helical grooves or bars 33, which are operative to provide favorable feeding of the goods and to counteract any tendency of the goods to rotate with the rotor 18. The goods are homogenized between the conical inner defining surfaces of the beater means 19 and 20, and said goods are finally treated in the gaps 23 between said means. Subsequent to this final treatment stage, the goods are fed into a collecting chamber 36 in the beater housing 29 and conveyed out of the beater through an outlet stub not shown.

The invention is not limited to the aforedescribed embodiment, but can be modified within the scope of the claims. The aforedescribed embodiment represents a favorable solution to the problems mentioned in the introduction in respect of disc-refiners having a rotor surrounded by two stator parts. It is well-known that all pre-beating and beating of paper pulp to promote the strength of the resultant paper should be carried out at concentrations much higher than hitherto constructions, which is limited to about 6% as a result of the design of the refiners. In accordance with the present invention, a disc refiner having two beater zones can be used for refining pulp of both low and high concentrations and for the treatment of lump goods, said refiner with two zones affording a high capacity, low energy consumption and being fed from one side only.

What is claimed is:

1. A twin-flow, single side inlet type refining beater comprising:

a central body;

two outer parts surrounding said central body, said central body and said outer parts being relatively rotatable, and passages being defined between said central body and said two outer parts;

said central body including two ring-shaped beater means (19) on opposite sides of said central body;

each of said outer parts respectively including a ring-shaped beater means (20) on respective opposite sides of said central body to form two beater zones (23) between said beater means, one beater zone on each side of said central body, in which beater zones the goods to be refined are treated during passage thereof substantially radially outwardly and as a result of relative rotation between said central body and said outer parts;

said central body further including a cavity (26) with a single axial inlet thereto for the goods to be refined, and inclined radially converging substantially V-shaped walls surrounding the cavity and at least partially defining the cavity, the inclined cavity defining walls having a plurality of holes (32) therein through which said goods can be passed to the respective beater zones via said passages formed between the central body and said outer parts, said cavity (26) being substantially round in at least one plane and having a diameter in said plane which is substantially greater than the largest cross-sectional dimension of said axial inlet; and a rotatable propeller-like means (34) arranged in said cavity (26) to disintegrate said goods fed to said cavity and to spread said goods by centrifugal force to substantially uniformly fill the space between said propeller-like means and said inclined cavity defining walls and thereafter to divide said goods into two substantially equal flows which pass out through said holes (32) in respective cavity defining walls and into said passages connecting therewith.

2. A beater according to claim 1, wherein said rotor comprises outer wings for feeding the material thrown through said holes (32) to an associated beater zone via a respective passage.

3. A beater according to claim 1 or 2, wherein said single axial inlet of said central body is substantially round, and wherein said diameter of said cavity (26) is substantially greater than the diameter of said single axial inlet to thereby provide space for said goods thrown out by said propeller-like means to uniformly fill said space between said propeller-like means and said inclined cavity defining walls.

4. A beater according to claim 1, wherein said cavity is symmetrical on both sides of a symmetry plane which forms a right angle with a longitudinal axis of said beater.

5. A beater according to claim 1, wherein the central body is rotatable and serves as a rotor and the surrounding outer parts are fixed.

6. A beater according to claim 5, wherein the rotor is provided with outer wings for feeding the material thrown through said hole to an associated beater zone via a respective passage.

7. A beater according to claim 6, wherein said outer parts have generally helical vanes (33) thereon which are arranged to co-act with said wings of said rotor.

8. A beater according to claim 6, wherein said outer parts have generally helical grooves therein which are arranged to co-act with said wings of said rotor.

9. A beater according to claim 6, wherein said wings (35) are arranged between said holes (32).

10. A beater according to claim 1, wherein the number of said holes (32) in each of said converging walls is the same.

11. A beater according to claim 1, wherein said central body is generally disc shaped.

12. A beater according to claim 1, wherein said central body is generally disc shaped and is rotatable about a central axis thereof which extends perpendicular thereto, said central axis being the longitudinal axis of said beater.

13. A beater according to claim 1, wherein said holes (32) in the converging walls of the central body extend generally radially.

14. A beater according to claim 1, wherein each of the converging walls of the central body is provided with the same number of holes, said holes being identically positioned in each of said walls.

15. A beater according to claim 1, wherein said converging walls form an angle of about 30°–60° to a longitudinal axis of said beater.

* * * * *